US009808067B2

(12) United States Patent
Sutter et al.

(10) Patent No.: US 9,808,067 B2
(45) Date of Patent: Nov. 7, 2017

(54) ATTACHMENT FOR A HANDHELD APPLIANCE

(71) Applicant: Dyson Technology Limited, Wiltshire (GB)

(72) Inventors: Catriona Ann Crawley Sutter, Exeter (GB); Stephen Farrar Smith, Bristol (GB); Edward Sebert Maurice Shelton, Swindon (GB); Patrick Joseph William Moloney, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 556 days.

(21) Appl. No.: 14/339,014

(22) Filed: Jul. 23, 2014

(65) Prior Publication Data

US 2015/0026993 A1 Jan. 29, 2015

(30) Foreign Application Priority Data

Jul. 24, 2013 (GB) ..... 1313193.3

(51) Int. Cl.

| | |
|---|---|
| ***A45D 20/12*** | (2006.01) |
| ***A45D 20/10*** | (2006.01) |
| ***F24H 3/04*** | (2006.01) |

(52) U.S. Cl.

CPC ..... *A45D 20/12* (2013.01); *A45D 20/10* (2013.01); *A45D 20/122* (2013.01); *F24H 3/0423* (2013.01)

(58) Field of Classification Search

CPC ..... A45D 20/10; A45D 20/12; A45D 20/122; A45D 20/124; F24H 3/0423

(Continued)

(56) References Cited

U.S. PATENT DOCUMENTS

| | | | |
|---|---|---|---|
| 3,943,329 | A | 3/1976 | Hlavac |
| 4,250,902 | A | 2/1981 | Ihara |

(Continued)

FOREIGN PATENT DOCUMENTS

| | | |
|---|---|---|
| CH | 588 835 | 6/1977 |
| CN | 200973446 | 11/2007 |

(Continued)

OTHER PUBLICATIONS

Search Report dated Jan. 23, 2014, directed to GB Application No. 1313193.3; 2 pages.

(Continued)

*Primary Examiner* — David J Laux

(74) *Attorney, Agent, or Firm* — Morrison & Foerster LLP

(57) ABSTRACT

An attachment for a handheld appliance, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall. The first end of the appliance may be substantially circular. The fluid flow path may have a fluid inlet that may be annular at the first end. The fluid inlet may be defined by the first wall and an inner wall extending around and at least partially along the first wall. The inner wall may be substantially equidistant from the first wall around the fluid inlet. A hair care appliance comprises such as attachment.

45 Claims, 12 Drawing Sheets

(58) Field of Classification Search
USPC ..... 34/96, 97; D28/13
See application file for complete search history.

(56) References Cited

U.S. PATENT DOCUMENTS

| | | | |
|---|---|---|---|
| 4,287,673 | A | 9/1981 | Wolter |
| 4,350,872 | A | 9/1982 | Meywald et al. |
| 4,596,921 | A | 6/1986 | Hersh et al. |
| 4,767,914 | A | 8/1988 | Glucksman |
| 5,133,043 | A | 7/1992 | Baugh |
| D350,413 | S | 9/1994 | Feil |
| D352,365 | S | 11/1994 | Hansen et al. |
| 5,378,882 | A | 1/1995 | Gong et al. |
| 5,546,674 | A | 8/1996 | Lange et al. |
| 5,572,800 | A | 11/1996 | West |
| 5,598,640 | A | 2/1997 | Schepisi |
| 5,628,123 | A | 5/1997 | Chan |
| 5,649,370 | A | 7/1997 | Russo |
| 5,681,630 | A | 10/1997 | Smick et al. |
| D398,074 | S | 9/1998 | Nosenchuck |
| 5,841,943 | A | 11/1998 | Nosenchuck |
| 5,875,562 | A | 3/1999 | Fogarty |
| 6,203,349 | B1 | 3/2001 | Nakazawa |
| 6,751,886 | B2 | 6/2004 | Chang et al. |
| 6,763,183 | B1 | 7/2004 | Huang |
| 6,889,445 | B1 | 5/2005 | Varona et al. |
| D550,813 | S | 9/2007 | Lammel et al. |
| D646,354 | S | 10/2011 | Gessi |
| 8,132,571 | B1 | 3/2012 | Jackson |
| D696,386 | S | 12/2013 | Schoenherr et al. |
| D702,322 | S | 4/2014 | Sieger |
| 2001/0048810 | A1 | 12/2001 | Cheng |
| 2002/0129512 | A1 | 9/2002 | Cheng |
| 2003/0079366 | A1 | 5/2003 | Chang |
| 2004/0083620 | A1 | 5/2004 | McCambridge et al. |
| 2004/0163274 | A1 | 8/2004 | Andrew et al. |
| 2004/0172847 | A1 | 9/2004 | Saida et al. |
| 2005/0229422 | A1 | 10/2005 | Mattinger et al. |
| 2006/0075654 | A1 | 4/2006 | Lin |
| 2007/0294909 | A1 | 12/2007 | Abdi et al. |
| 2008/0263887 | A1 | 10/2008 | Nakasone et al. |
| 2008/0271337 | A1 | 11/2008 | Chan |
| 2009/0052877 | A1 | 2/2009 | Cheng |
| 2010/0064542 | A1 | 3/2010 | Mulvaney et al. |
| 2010/0065545 | A1 | 3/2010 | Chung et al. |
| 2011/0079239 | A1 | 4/2011 | Hall |
| 2011/0099832 | A1 | 5/2011 | Bikhazi |
| 2011/0177711 | A1 | 7/2011 | Park |
| 2011/0203128 | A1 | 8/2011 | Rodrigues |
| 2013/0111777 | A1 | 5/2013 | Jeong |
| 2013/0239427 | A1 | 9/2013 | Quessard et al. |
| 2013/0269200 | A1 | 10/2013 | Moloney et al. |
| 2013/0269201 | A1 | 10/2013 | Courtney et al. |
| 2013/0276320 | A1 | 10/2013 | Courtney et al. |
| 2013/0276321 | A1 | 10/2013 | Courtney et al. |
| 2013/0283630 | A1 | 10/2013 | Courtney et al. |
| 2013/0283631 | A1 | 10/2013 | Moloney et al. |
| 2014/0007448 | A1 | 1/2014 | Courtney et al. |
| 2014/0007449 | A1 | 1/2014 | Courtney et al. |
| 2014/0290087 | A1 | 10/2014 | Weatherly |
| 2016/0206075 | A1 | 7/2016 | Stephens et al. |
| 2016/0206076 | A1 | 7/2016 | Stephens et al. |
| 2016/0206077 | A1 | 7/2016 | Stephens et al. |

FOREIGN PATENT DOCUMENTS

| | | |
|---|---|---|
| CN | 201328477 | 10/2009 |
| CN | 201341553 | 11/2009 |
| CN | 101292806 | 10/2010 |
| CN | 201774080 | 3/2011 |
| CN | 201879007 | 6/2011 |
| CN | 201948229 | 8/2011 |
| CN | 202146022 | 2/2012 |
| CN | 202436392 | 9/2012 |
| CN | 202536440 | 11/2012 |
| CN | 202774786 | 3/2013 |
| CN | 202874233 | 4/2013 |
| DE | 1 829 117 | 4/1961 |
| DE | 26 18 819 | 11/1977 |
| DE | 277 118 | 3/1990 |
| DE | 195 27 111 | 1/1997 |
| DE | 10 2009 049 838 | 4/2011 |
| EP | 0 105 810 | 4/1984 |
| EP | 0 284 690 | 10/1988 |
| EP | 0 300 281 | 1/1989 |
| EP | 0 306 765 | 3/1989 |
| EP | 0 970 633 | 1/2000 |
| EP | 1 433 401 | 8/2004 |
| EP | 1 616 500 | 1/2006 |
| EP | 2 000 042 | 12/2008 |
| EP | 2 255 692 | 12/2010 |
| EP | 2 392 223 | 12/2011 |
| EP | 2 401 939 | 1/2012 |
| EP | 2 869 726 | 5/2015 |
| FR | 1387334 | 1/1965 |
| FR | 1408096 | 8/1965 |
| GB | 647291 | 12/1950 |
| GB | 953057 | 3/1964 |
| GB | 1 446 385 | 8/1976 |
| GB | 1 456 000 | 11/1976 |
| GB | 1 489 723 | 10/1977 |
| GB | 1 539 485 | 1/1979 |
| GB | 2 295 056 | 5/1996 |
| GB | 2 316 868 | 3/1998 |
| GB | 2472240 | 2/2011 |
| GB | 2478927 | 9/2011 |
| GB | 2482547 | 2/2012 |
| GB | 2482548 | 2/2012 |
| GB | 2482549 | 2/2012 |
| GB | 2500798 | 10/2013 |
| GB | 2500800 | 10/2013 |
| GB | 2503684 | 1/2014 |
| GB | 2503685 | 1/2014 |
| GB | 2503686 | 1/2014 |
| GB | 2515813 | 1/2015 |
| GB | 2516478 | 1/2015 |
| JP | 41-22432 | 11/1966 |
| JP | 53-36991 | 3/1978 |
| JP | 55-218 | 1/1980 |
| JP | 55-79904 | 6/1980 |
| JP | 55-153002 | 11/1980 |
| JP | 56-26004 | 3/1981 |
| JP | 56-106103 | 8/1981 |
| JP | 60-135700 | 7/1985 |
| JP | 61-50507 | 3/1986 |
| JP | 63-83104 | 6/1988 |
| JP | 1-27506 | 1/1989 |
| JP | 1-29208 | 1/1989 |
| JP | 2-29603 | 2/1990 |
| JP | 4-221507 | 8/1992 |
| JP | 4-130705 | 11/1992 |
| JP | 5-7507 | 1/1993 |
| JP | 5-130915 | 5/1993 |
| JP | 5-176811 | 7/1993 |
| JP | 7-16113 | 1/1995 |
| JP | 7-155219 | 6/1995 |
| JP | 3014299 | 8/1995 |
| JP | 8-343 | 1/1996 |
| JP | 8-322633 | 12/1996 |
| JP | 2000-201723 | 7/2000 |
| JP | 2001-37530 | 2/2001 |
| JP | 2002-238649 | 8/2002 |
| JP | 2003-153731 | 5/2003 |
| JP | 2004-312 | 1/2004 |
| JP | 2004-113402 | 4/2004 |
| JP | 2004-208935 | 7/2004 |
| JP | 2004-283549 | 10/2004 |
| JP | 2004-293389 | 10/2004 |
| JP | 2004-357763 | 12/2004 |
| JP | 2005-546 | 1/2005 |
| JP | 2006-51181 | 2/2006 |
| JP | 2006-130181 | 5/2006 |
| JP | 2006-141490 | 6/2006 |
| JP | 2006-181265 | 7/2006 |

(56) References Cited

FOREIGN PATENT DOCUMENTS

| | | |
|---|---|---|
| JP | 2007-136121 | 6/2007 |
| JP | 2008-200429 | 9/2008 |
| JP | 2010-274050 | 12/2010 |
| JP | 2012-45178 | 3/2012 |
| JP | 2012-157382 | 8/2012 |
| JP | 2013-162830 | 8/2013 |
| KR | 20-0206074 | 12/2000 |
| KR | 20-2011-0002484 | 3/2011 |
| KR | 10-1372045 | 3/2014 |
| WO | WO-83/02753 | 8/1983 |
| WO | WO-94/23611 | 10/1994 |
| WO | WO-2004/006712 | 1/2004 |
| WO | WO-2005/120283 | 12/2005 |
| WO | WO-2007/043732 | 4/2007 |
| WO | WO-2008/053099 | 5/2008 |
| WO | WO-2012/059700 | 5/2012 |
| WO | WO-2012/069983 | 5/2012 |
| WO | WO-2012/076885 | 6/2012 |
| WO | WO-2014/001770 | 1/2014 |
| WO | WO-2014/006365 | 1/2014 |
| WO | WO-2014/147460 | 9/2014 |
| WO | WO-2015/001310 | 1/2015 |
| WO | WO-2015/011442 | 1/2015 |

OTHER PUBLICATIONS

Reba, I. (1966). "Applications of the Coanda Effect," Scientific American 214:84-92.

International Search Report and Written Opinion dated Dec. 8, 2014, directed to International Application No. PCT/GB2014/052031; 16 pages.

ATTACHMENT FOR A HANDHELD APPLIANCE

REFERENCE TO RELATED APPLICATIONS

This application claims the priority of United Kingdom Application No. 1313193.3 filed Jul. 24, 2013, the entire contents of which are incorporated herein by reference.

FIELD OF THE INVENTION

This invention relates to an attachment for a handheld appliance, in particular it relates to an attachment for a hair care appliance such as a hairdryer.

BACKGROUND OF THE INVENTION

Removable attachments for hairdryer can have a number of different uses. The usually circular flow exiting the hairdryer can be concentrated and flattened using a concentrator nozzle/attachment or it can be expanded and slowed by a diffuser. The different types of attachment dry the hair at different speeds with different flow rates enabling different styles to be created.

The fluid outlet of the attachment can become blocked and this is undesirable as blockage can cause damage to the fan unit that produced the fluid flowing through the attachment.

The fluid flowing through the attachment is often heated causing the outer surface of the attachment to become uncomfortably hot to touch.

SUMMARY OF THE INVENTION

The present invention provides an attachment for a handheld appliance, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall.

Preferably, the first end of the appliance is substantially circular.

It is preferred that the fluid flow path has a fluid inlet at the first end. Preferably, the fluid inlet is annular. Preferably, the fluid inlet is defined by the first wall and an inner wall extending around and at least partially along the first wall. It is preferred that the inner wall is substantially equidistant from the first wall around the fluid inlet.

Also provided is an attachment for a handheld appliance, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall wherein the fluid inlet is defined by the first wall and an inner wall extending around and at least partially along the first wall.

Preferably, the fluid flow path is defined by the first wall and the inner wall.

It is preferred that the inner wall is substantially equidistant from the first wall along the inner wall. Preferably, the inner wall is substantially equidistant from the first wall around the inner wall.

It is preferred that the second end of the attachment is non-circular. Preferably, the second end of the attachment has a dimension that is greater than the first end of the attachment. It is preferred that the second end of the attachment describes an ellipse.

Preferably, the second fluid flow path extends substantially continuously around the fluid flow path.

Alternatively, the second fluid flow path is non-continuous around the first fluid flow path. Preferably, the second fluid flow path extends around the first fluid flow path in the dimension that is greater than the first end of the attachment.

It is preferred that the second wall comprises a fluid outlet from the attachment.

Preferably, the first wall comprises a first section and a second section wherein the first section is a different shape to the second section. It is preferred that the first section extends from the first end of the attachment. Preferably, the first section is frustoconical.

Also provided is an attachment for a handheld appliance, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall, wherein the first wall comprises a first section and a second section wherein the first section is a different shape to the second section.

It is preferred that the second section extends from the first section towards the second end wherein the second section is elliptical.

Preferably, the second wall extends from the second end at least partially along the second section of the first wall.

It is preferred that an inner wall is provided and the inner wall extends along the first section of the attachment. Preferably, the inner wall is equidistant from the first wall along the length of the inner wall. It is preferred that the inner wall is equidistant from the first wall radially around the inner wall.

Preferably, the second fluid flow path includes a fluid opening at the second end. It is preferred that the fluid opening is defined by the first wall and the inner wall. Preferably, the fluid opening is elliptical.

It is preferred that the second fluid flow path includes a further fluid opening which is at least partially defined by the first wall.

Also provided in an attachment for a handheld appliance, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall wherein an inner wall is provided and the fluid opening is defined by the first wall and the inner wall.

Preferably, either the fluid opening or the further fluid opening is a fluid inlet.

It is preferred that either of the fluid opening or further fluid opening is a fluid outlet.

Preferably, the first wall comprises a plurality of ribs extending at least between the first and second walls.

It is preferred that the second wall comprises ribs extending between the first and second walls.

Preferably, the ribs extend radially around the attachment between the first and second walls.

It is preferred that in use, fluid flowing in the fluid flow path flows from the first end towards the second end.

Preferably, in use, fluid flowing in the second fluid flow path flows either from the first end towards the second end or from the second end towards the first end.

Also provided is an attachment for a handheld appliance, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall, wherein in use, fluid flowing in the second fluid flow path flows either from the first end towards the second end or from the second end towards the first end.

It is preferred that fluid output from the attachment is output from the second end of the attachment.

Preferably, the fluid output is a combination of fluid from the fluid flow path and fluid from the second fluid flow path.

It is preferred that fluid from the fluid flow path flows along the second fluid flow path to a fluid opening formed between the first wall and the second wall.

Preferably, the first wall is made from a plastic material.

It is preferred that the second wall is made from a plastic material.

Preferably, the second wall is formed from a flexible material. It is preferred that the flexible material is a silicon rubber.

According to a second aspect, a hair care appliance comprising an attachment as herein described is provided.

According to a third aspect, there is provided a hair care appliance comprising a handle and a body, a primary fluid flow path extending from a primary fluid inlet into the appliance to a primary fluid outlet for emitting the fluid flow from a front end of the body, a fan unit for drawing primary flow into the primary fluid inlet and an attachment, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall.

Preferably, the fluid flow path extends from a fluid inlet into to attachment to a fluid outlet exiting a front end of the attachment and the fluid inlet is in fluid communication with the primary fluid outlet.

It is preferred that the body comprises a duct; a further fluid flow path extending through the duct and from a further fluid inlet through which a further fluid flow enters the appliance to a further fluid outlet for emitting the further fluid flow from a front end of the body and wherein the further fluid flow is drawn through the further fluid flow path by fluid emitted from the primary fluid outlet, and wherein the fluid inlet into the attachment is annular.

Also provided is a hair care appliance comprising a handle and a body, a primary fluid flow path extending from a primary fluid inlet into the appliance to a primary fluid outlet for emitting the fluid flow from a front end of the body, a fan unit for drawing primary flow into the primary fluid inlet and an attachment, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall wherein the fluid inlet into the attachment is annular.

Preferably, the body comprises a duct; a further fluid flow path extending through the duct and from a further fluid inlet through which a further fluid flow enters the appliance to a further fluid outlet for emitting the further fluid flow from a front end of the body and wherein the further fluid flow is drawn through the further fluid flow path by fluid emitted from the primary fluid outlet.

Preferably, the attachment further comprises an inner wall and the inner wall extends across the further fluid outlet reducing the further fluid flow that is drawn into the further fluid flow path.

It is preferred that the inner wall further defines along with the first wall the fluid flow path through the attachment.

Preferably, the inner wall is cone shaped and the base of the cone extends into the duct.

It is preferred that the inner wall further includes a base wall that extends across the base of the cone.

Preferably, the primary fluid inlet is in the handle.

Also provided is a hair care appliance comprising a handle and a body, a primary fluid flow path extending from a primary fluid inlet into the appliance to a primary fluid outlet for emitting the fluid flow from a front end of the body, a fan unit for drawing primary flow into the primary fluid inlet and an attachment, the attachment having a first end for connection to the appliance and a second end, a first wall extending from the first end towards the second end and defining a fluid flow path through the attachment, a second wall extending from the second end towards the first end about the first wall and defining a second fluid flow path extending between the first wall and the second wall wherein the primary fluid inlet is in the handle.

It is preferred that the fan unit is in the handle.

Preferably, the hair care appliance is a hairdryer.

BRIEF DESCRIPTION OF THE DRAWINGS

The invention will now be described by way of example, with reference to the accompanying drawings, of which.

DETAILED DESCRIPTION OF THE INVENTION

Figure 1:
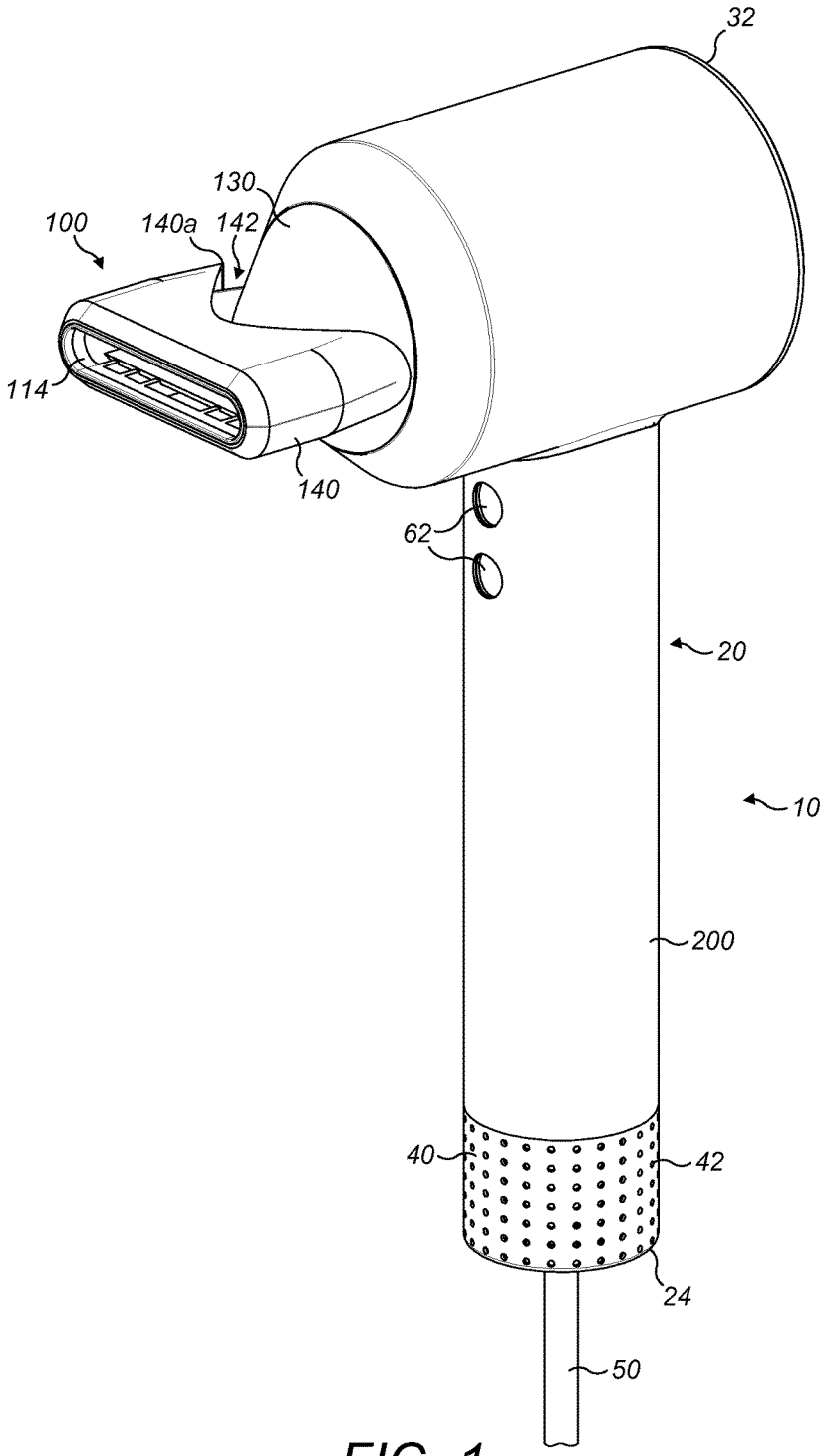
FIG. 1 shows a perspective view of an appliance having an attachment according to the invention.
Figure 2:
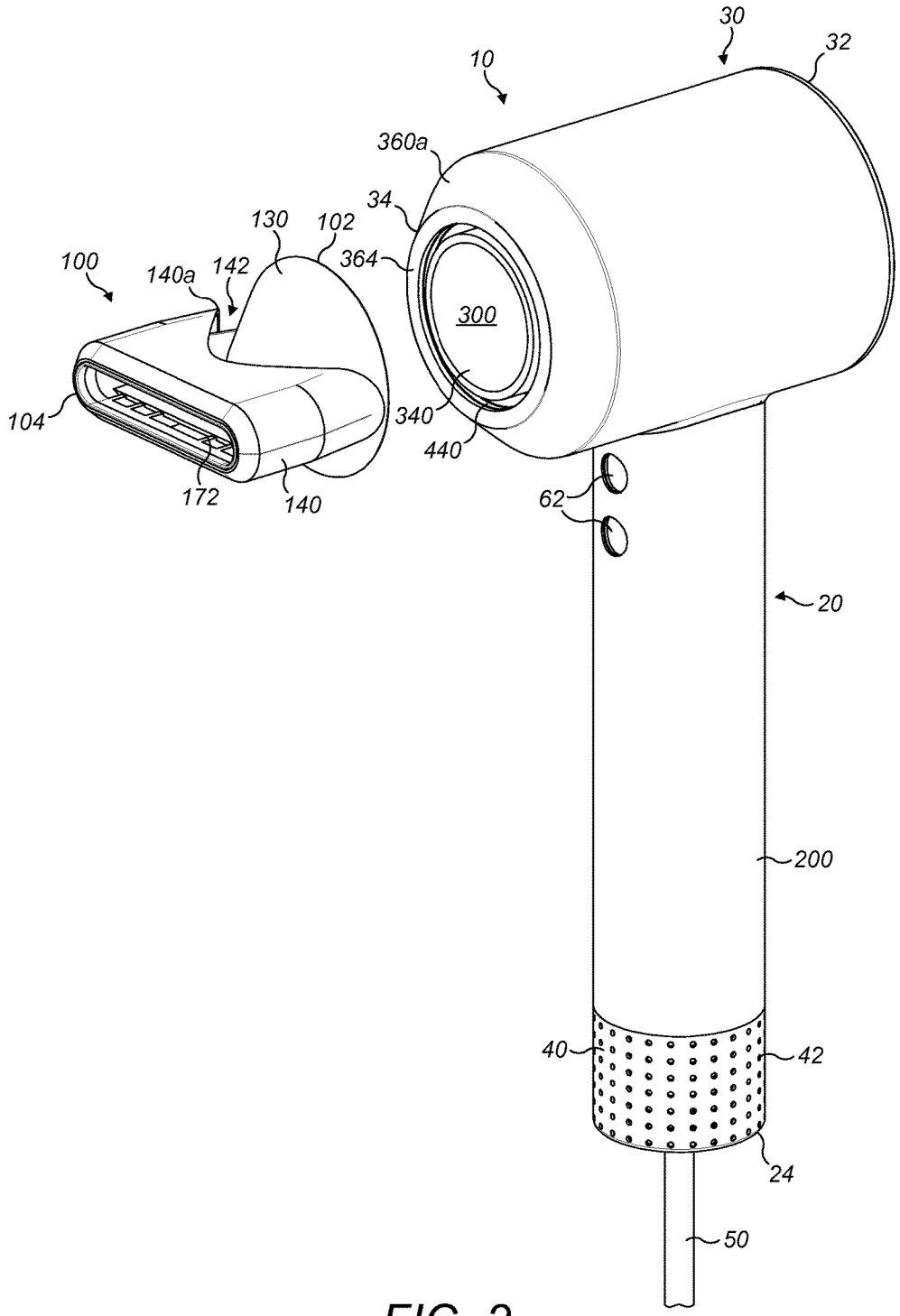
FIG. 2 shows an exploded perspective view of the appliance and attachment of FIG. 1.
Figure 3:
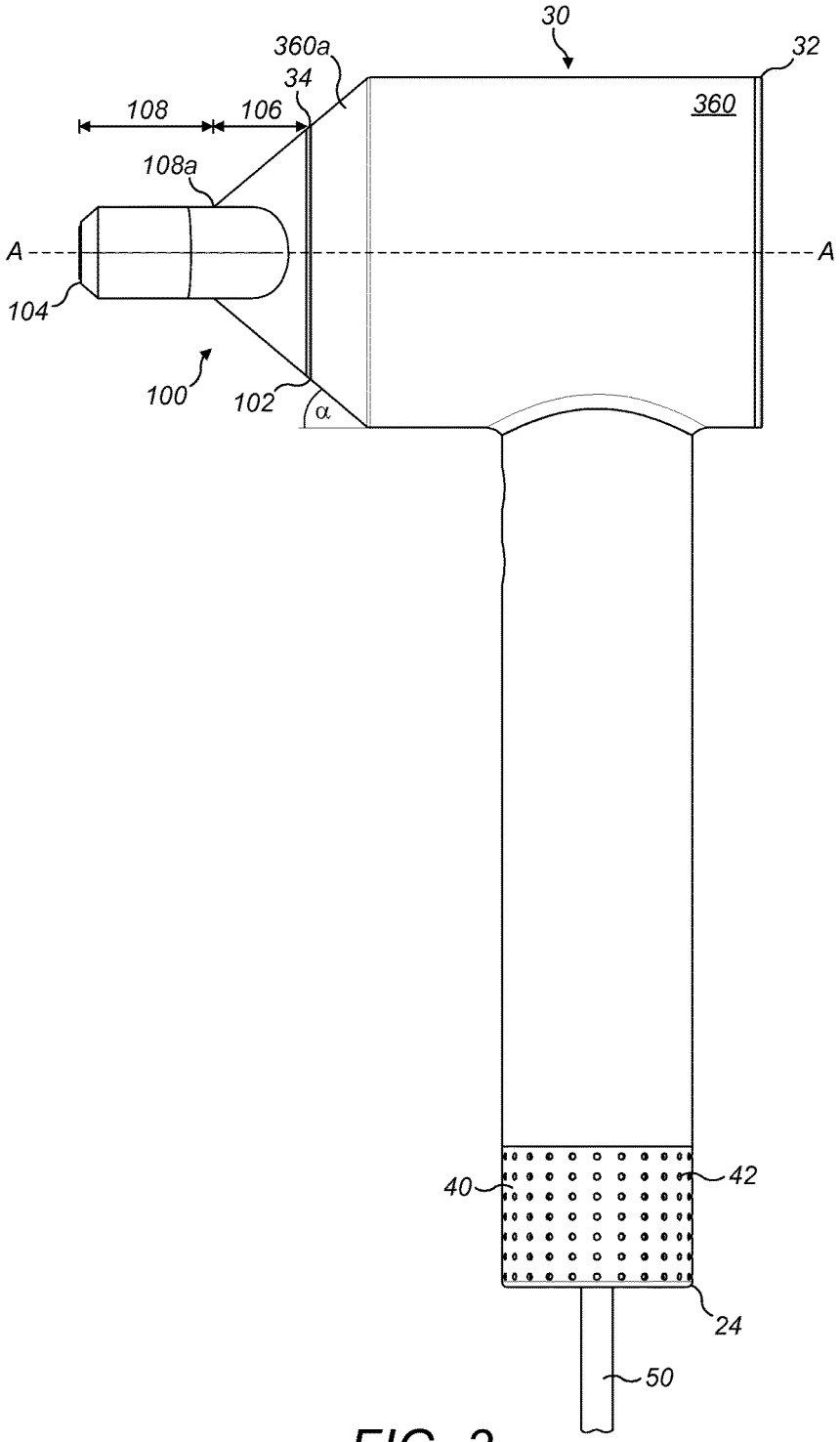
FIG. 3 shows a side view of the appliance and attachment of FIG. 1.
Figure 4:
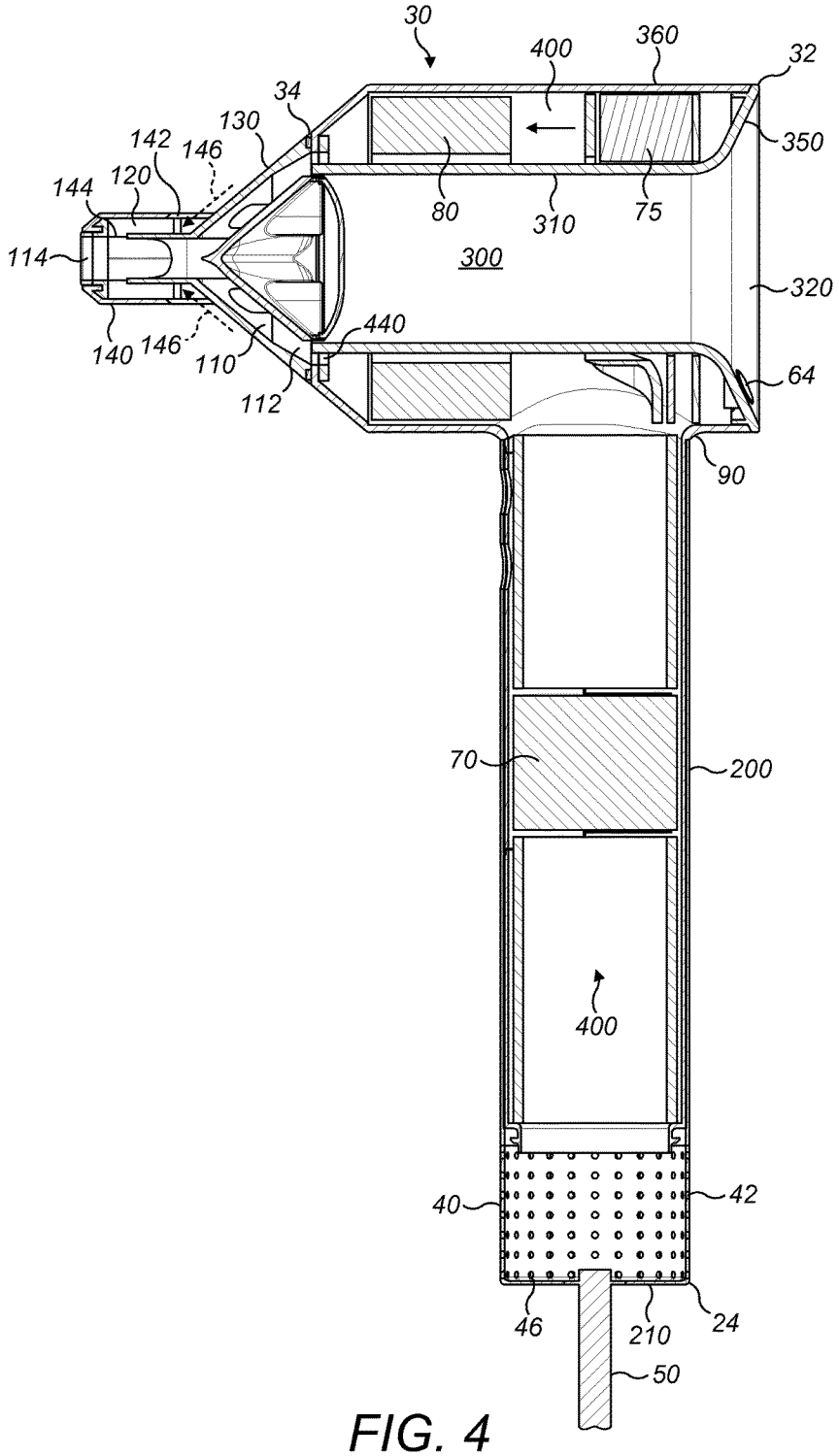
FIG. 4 shows a cross section through the side view of FIG. 3.

FIGS. 1 to 4 show a hairdryer 10 and an attachment 100. The hairdryer has a handle 20 and a body 30. The body has a first end 32 and a second end 34. Referring in particular to FIG. 4, the handle 20 has an outer wall 200 which extends from the body 30 to a distal end 24 of the handle. At the distal end 24 of the handle an end wall 210 extends across the outer wall 200. The cable 50 enters the hairdryer through this end wall 210. The handle 20 includes a primary inlet 40 having first apertures that extend around and along 42 the outer wall 200 of the handle and second apertures that extend across 46 and through the end wall 210 of the handle 20. The cable 50 is located approximately in the middle of the end wall 210 so extends from the centre of the handle 20. The end wall 210 is orthogonal to the outer wall 200 of the handle.

Referring in particular to FIG. 4, upstream of the primary inlet 40, a fan unit 70 is provided. The fan unit 70 includes a fan and a motor. The fan unit 70 draws fluid through the primary inlet 40 towards the body 30 through a fluid flow path 400 that extends from the primary inlet 40 and into the body 30 where the handle 20 and the body 30 are joined 90. The fluid flow path 400 continues through the body 30 towards the second end 34 of the body, through a heater 80 and to a primary fluid outlet 440 at the second end 34 of the body where fluid that is drawn in by the fan unit exits the primary fluid flow path 400. The primary fluid flow path 400 is non linear and flows through the handle 20 in a first direction and through the body 30 in a second direction which is orthogonal to the first direction.

The body 30 includes an outer wall 360 and an inner duct 310. The primary fluid flow path 400 extends along the body from the junction 90 of the handle 20 and the body 30 between the outer wall 360 and the duct 310 towards the primary fluid outlet 440 at the second end 34 of the body 30. The outer wall 360 of the body converges towards the duct 310 and a centre line A-A of the body 30.

Another fluid flow path is provided within the body; this flow is not directly processed by the fan unit or the heater but is drawn into the hairdryer by the action of the fan unit producing the primary flow through the hairdryer. This fluid flow is entrained into the hairdryer by the fluid flowing through the primary fluid flow path 400.

The first end 32 of the body includes a fluid inlet 320 and the second end 34 of the body includes a fluid outlet 340. Both the fluid inlet 320 and the fluid outlet 340 are at least partially defined by the duct 310 which is an inner wall of the body 30 and extends within and along the body. A fluid flow path 300 extends within the duct from the fluid inlet 320 to the fluid outlet 340. At the first end 32 of the body 30, a side wall 350 extends between the outer wall 360 and the duct 310. This side wall 350 at least partially defines the fluid inlet 320. At the second end 34 of the body a gap is provided between the outer wall 360 and the duct, this gap defines the primary fluid outlet 440. The primary fluid outlet 440 is annular and surrounds the fluid flow path.

The duct 310 is an internal wall of the hairdryer that can be accessed from outside the hairdryer. Thus, the duct 310 is an external wall of the hairdryer.

A PCB 75 including the control electronics for the hairdryer is located in the body 30 near the side wall 350 and fluid inlet 320. The PCB 75 is ring shaped and extends round the duct 310 between the duct 310 and the outer wall 360. The PCB 75 is in fluid communication with the primary fluid flow path 400. The PCB 75 extends about the fluid flow path 300 and is isolated from the fluid flow path 300 by the duct 310.

The PCB 75 controls such parameters as the temperature of the heater 80 and the speed of rotation of the fan unit 70. Internal wiring (not shown) electrically connects the PCB 75 to the heater 80 and the fan unit 70 and the cable 50. Control buttons 62, 64 are provided and connected to the PCB 75 to enable a user to select from a range of temperature settings and flow rates for example.

In use without an attachment, fluid is drawn into the primary fluid flow path 400 by the action of the fan unit 70, is optionally heated by the heater 80 and exits from the primary fluid outlet 440. This processed flow causes fluid to be entrained into the fluid flow path 300 at the fluid inlet 320. The fluid combines with the processed flow at the second end 34 of the body. In the example shown in FIG. 2, the processed flow exits the primary fluid outlet 440 and the hairdryer as an annular flow which surrounds the entrained flow that exits from the hairdryer via the fluid outlet 340. Thus fluid that is processed by the fan unit and heater is augmented by the entrained flow.

Referring in particular to FIGS. 4 to 7, the attachment 100 connects to the second end 34 of the hairdryer 100. The attachment 100 includes a first fluid flow path 110 for fluid communication with the primary fluid flow path 400 of the hairdryer and a second fluid flow path 120.

The attachment 100 has a first wall 130 which extends from a first end 102 and a second wall 140 which extends from a second end 104 of the attachment 100. In use, the first end 102 of the attachment is connected to the second end 34 of the hairdryer. In this embodiment the connection is achieved using magnetic attraction between one or more magnets or magnetic material 362 disposed behind a front face 364 of the second end 34 of the body 30 of the hairdryer and a ring of magnetic material 132 embedded in the first wall 130 at the first end 102 of the attachment (see FIG. 7). However, it will be apparent to the skilled person that there are other equally feasible ways of removably attaching the attachment.

The attachment 100 can be considered to have two external parts, a first part 106 extending from the first end 102 and a second part 108 extending from the second end 104. The first part 106 is generally conical in shape with the first end 102 being circular and adapted and sized to attach to the second end 34 of the hairdryer 10. The second part 108 is generally elliptical in shape to provide a focused flow of fluid out of the attachment. The first part 106 tapers towards the apex of the cone in the direction of flow i.e. from the first end 102 towards the second end 104 of the attachment. The angle $\alpha$ of the taper continues the line of the outer wall 360*a* of the hairdryer 10 towards the second end 34 which reduces in diameter towards the second end 34. The upstream end 108*a* of the second part 108 intersects with the cone before the first part 106 would reach the apex of the cone.

The first part 106 corresponds to a section of the first wall 130 being frustoconical 134 and the second part corresponds to a section of the first wall being generally elliptical 136.

Figure 6:
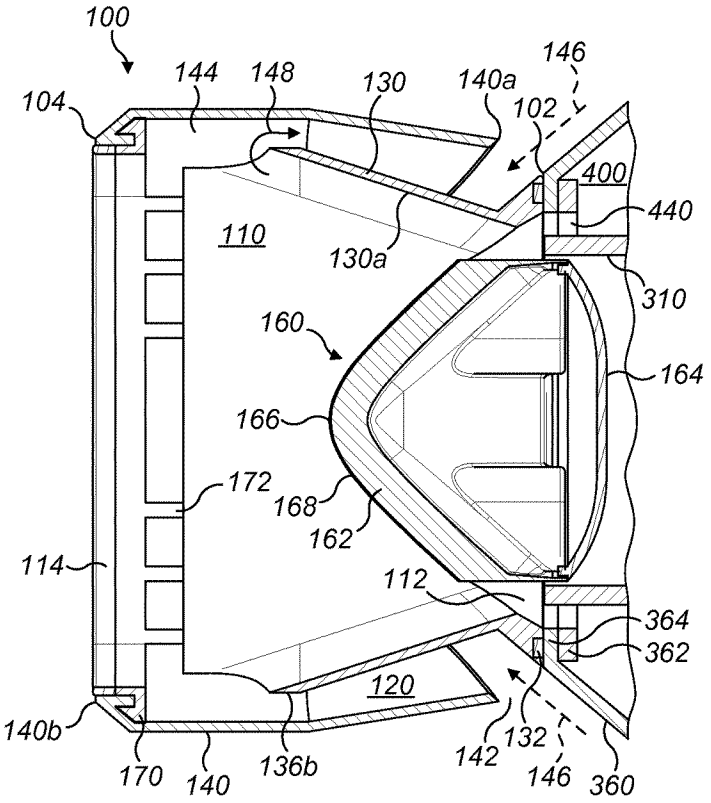
FIG. 6 shows a cross section through line A-A of FIG. 3.
Figure 5:
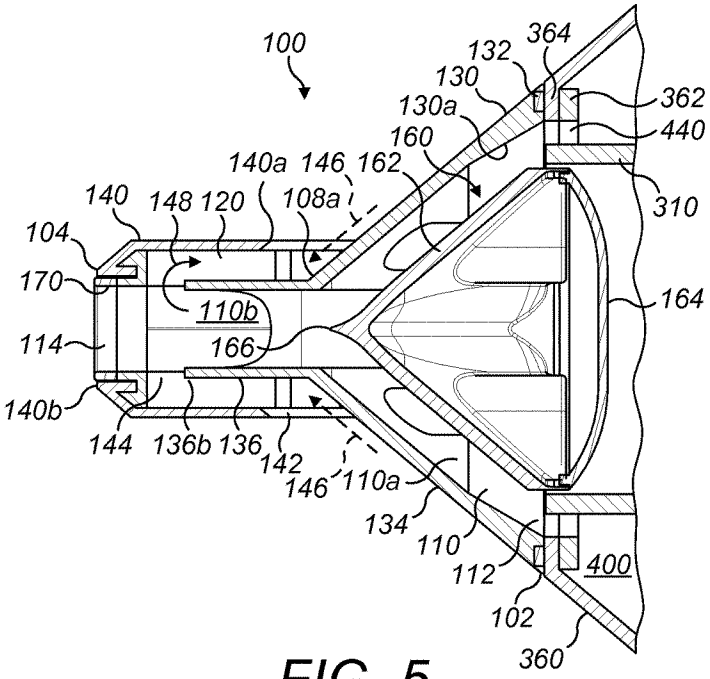
FIG. 5 shows a cross section through the side view of the attachment of FIG. 3.
Figure 7:
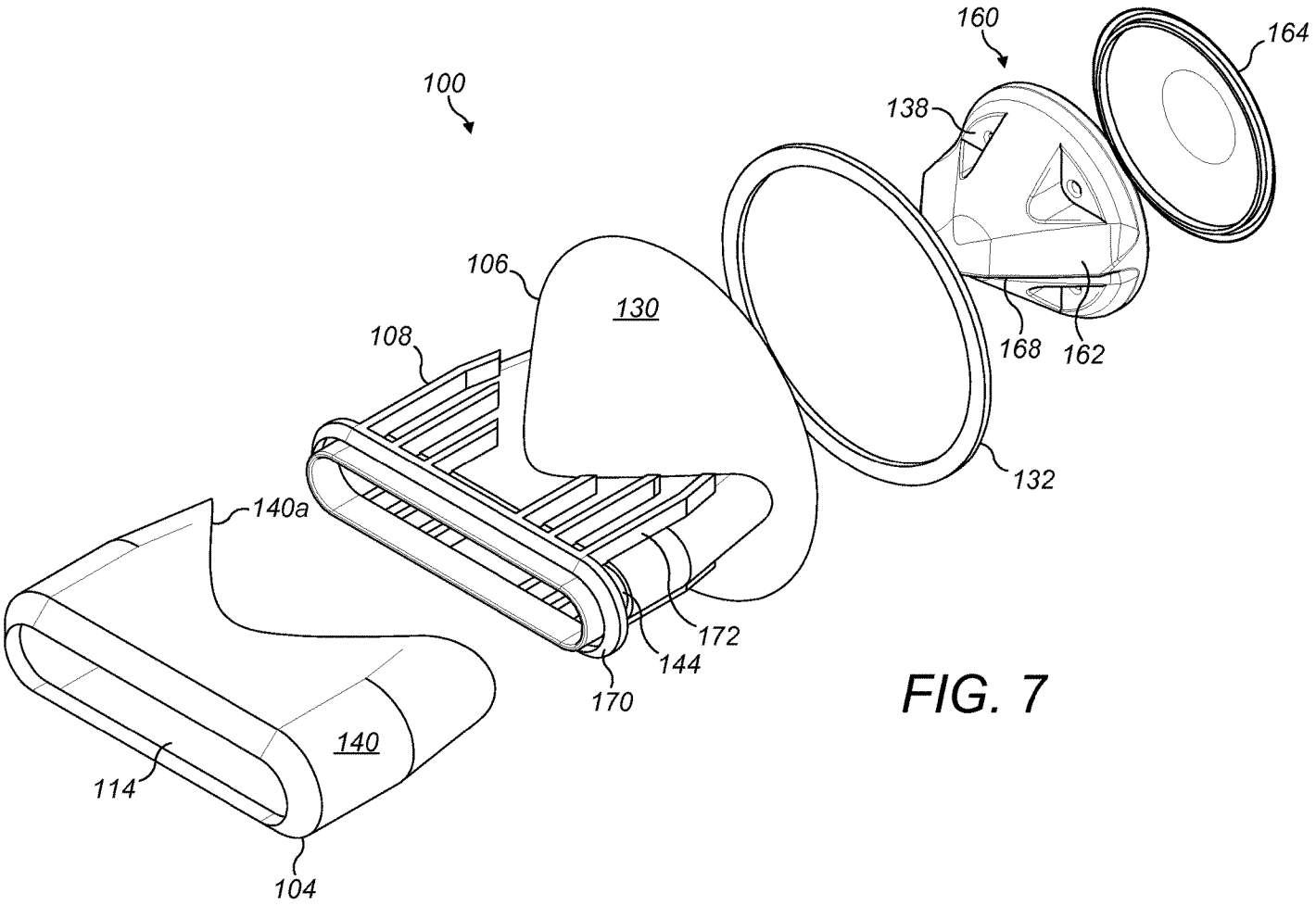
FIG. 7 shows an exploded view of the attachment shown in FIG. 1.
Figure 8:
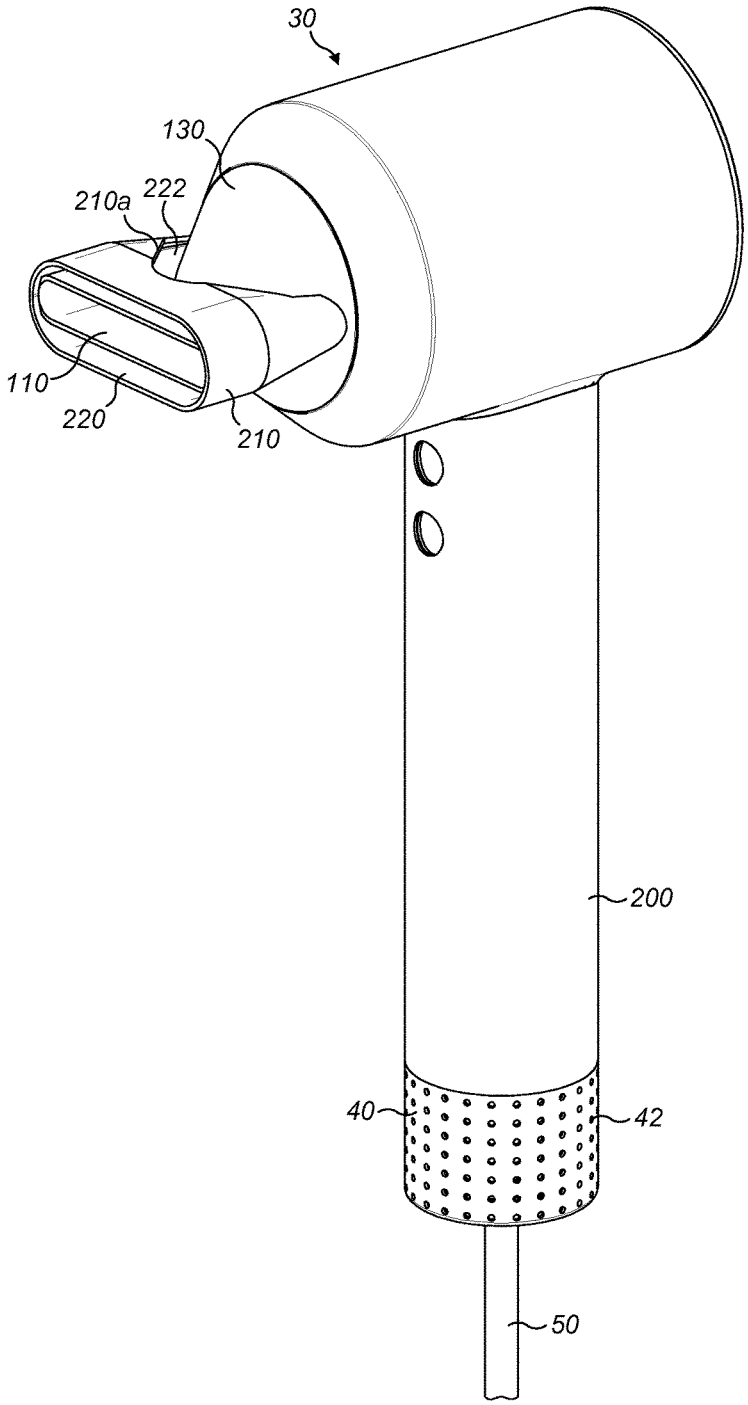
FIG. 8 show a perspective view of an appliance having an alternative attachment according to the invention.
Figure 9:
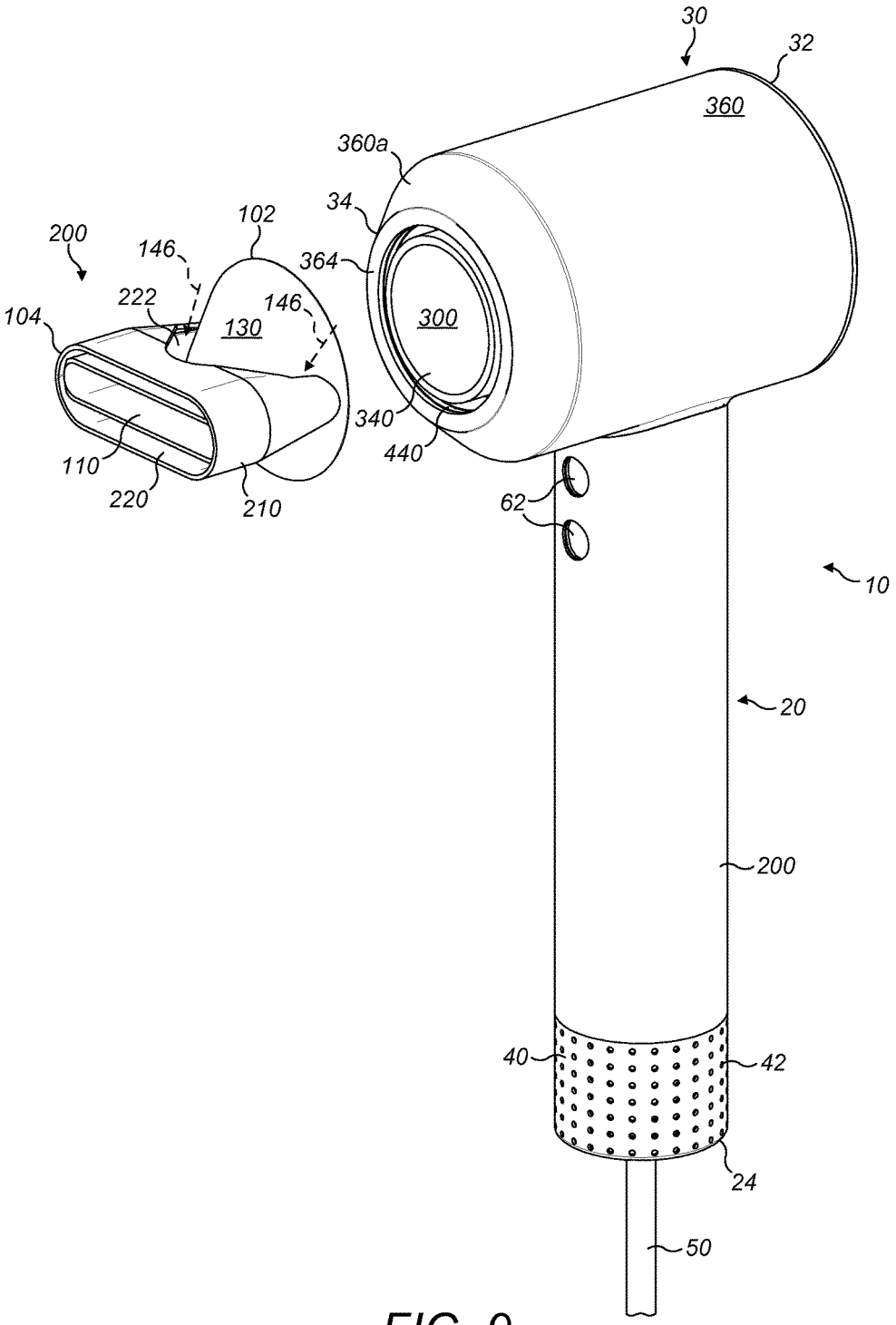
FIG. 9 shows an exploded perspective view of the appliance and alternative attachment of FIG. 8.
Figure 11:
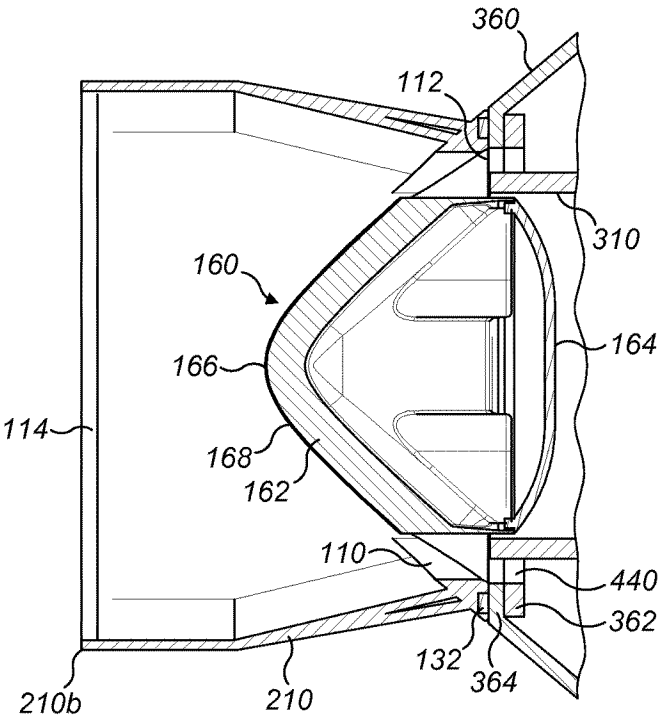
FIG. 11 shows an orthogonal cross section through the side view of the attachment of FIG. 8.
Figure 10:
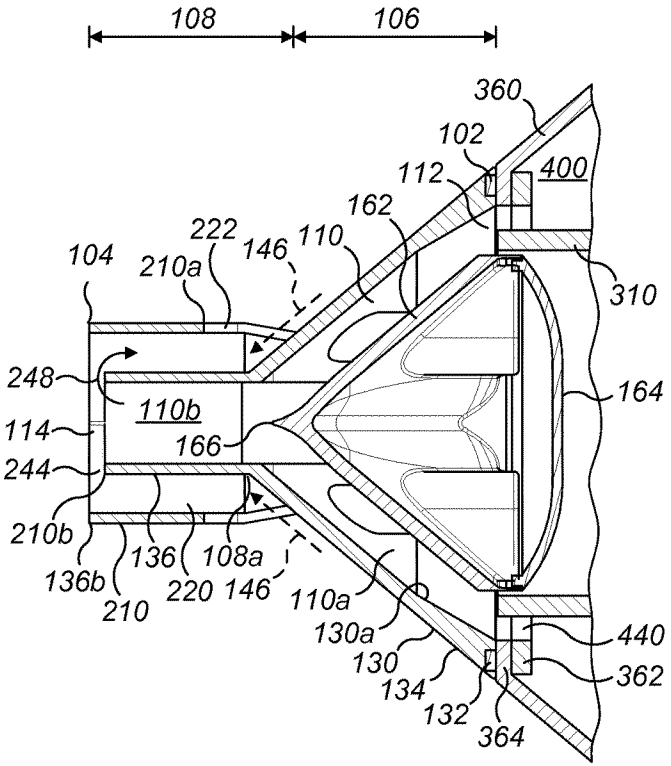
FIG. 10 shows a cross section through the side view of the attachment of FIG. 8.
Figure 13:
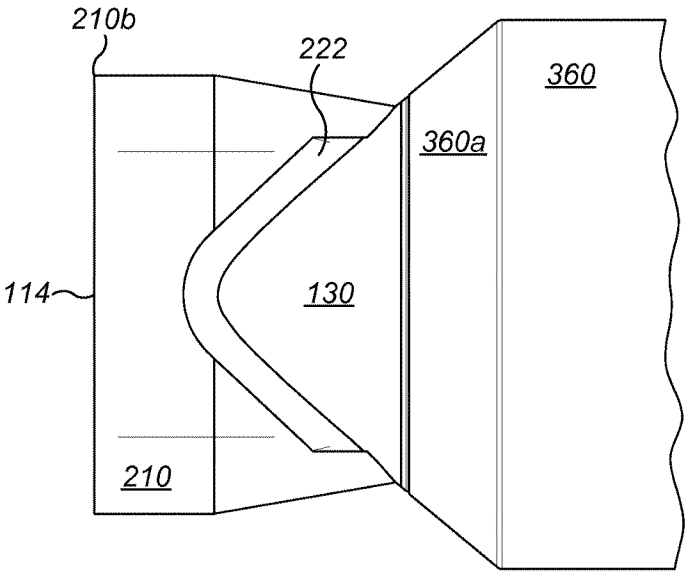
FIG. 13 shows a plan view of the attachment of FIG. 8.

Referring for FIGS. 5, 6 and 7 in particular, the attachment 100 has a first fluid flow path 110 formed initially between the first wall 130 and an internal bung 160. A fluid inlet 112 to the first fluid flow path 110 is provided in the first end 102 of the attachment and a fluid outlet 114 is provided at the second end 104 of the attachment. This first fluid flow path 110 is in fluid communication with the primary outlet 440 of the hairdryer when the attachment 100 is connected to the hairdryer 10.

The bung 160 has a side wall 162 and a base 164. The side wall 162 together with the inner surface 130*a* of the first wall 130 define the first fluid flow path 110 as it flows through the first part 106 of the attachment. The side wall 162 is generally conical and mirrors the shape described by the frustoconical section 134 of the first wall 130. Thus the gap or distance between the frustoconical section 134 and the side wall 162 is constant. As the first fluid flow path 110 flows into the second part 108 of the attachment the external shape changes from conical to generally elliptical so the side wall 162 flattens into a line 168 towards its' apex 166 and the annular flow 110*a* of the first fluid flow path 110 becomes an elliptical flow 110*b* (FIG. 7).

In this example, the bung 160 is ultrasonically welded to the inner surface 130*a* of the first wall 130 at four discrete locations 138 around the side wall 162 of the bung 160. The side wall 162 protrudes externally from the first wall 130 at the first end 102 so it can loosely engage with the duct 310 of the appliance 10 and at least partially block entrained flow that would usually be drawn into the fluid flow path 300 along the duct 310. Partially blocking the duct 310 is sufficient to prevent any significant entrainment along the fluid flow path 310 and also protects the duct 300 from damage when the attachment 100 is removed or if the appliance is dropped.

When the attachment 100 is attached and the appliance activated, primary flow output from the primary fluid outlet 440 of the hairdryer continues along the first fluid flow path 110 through the annular 110*a* and elliptical 110*b* sections to the fluid outlet 114 of the appliance.

The attachment includes a second wall 140 which extends from the second end 108 of the attachment towards the upstream end 108*a* of the second part. The second wall 140 extends about the first wall 130. The second wall 140 surrounds the first wall 130 and extends around the first wall on all sides or the entire circumference of the first wall 130.

The second wall 140 defines the fluid outlet 114 as the first wall 120 is recessed within the second wall 140 and does not extend all the way to the second end 108 of the attachment 100. A gap in the form of a fluid opening 144 is therefore provided between the downstream end 136*b* of the first wall 130 and the downstream end 140*b* of the second wall 140*b* at the second end 104 of the attachment.

The second wall 140 does not extend all the way to the upstream end 108*a* of the second part 108 of the attachment 100. Thus, a gap in the form of a second fluid opening 142 is provided between the upstream end 140*a* of the second wall 140 and the first wall 130. A second fluid flow path 120 is provided between the fluid opening 144 and second fluid opening 142 between the second wall 140 and the elliptical section 136 of the first wall 130.

During normal use i.e. when hair is being dried and styled, fluid flows along the first fluid flow path 110 from the primary fluid outlet 440 of the hairdryer 10 and passes through the annular section 110*a* and the generally elliptical section 110*b* towards the fluid outlet 114. The action of fluid flowing along this first fluid flow path 110 draws a second fluid 146 into the second fluid opening 142 and along the second fluid flow path 120 to the fluid opening 144 where the first 110 and second 120 fluid flows combine and exit the attachment at the fluid outlet 114. Thus, the first fluid flow is augmented by an entrained second fluid flow.

The second end 104 of the attachment is flat fronted so, there is a chance of a blockage of the fluid outlet 114 for example, if hair is positioned too close to the fluid outlet 114 limiting the volume of fluid that can exit through the fluid outlet 114. If this situation occurs, fluid from the first fluid flow path 110 has an escape path 148 through the fluid opening 144 along the second fluid flow path 120 to the second fluid opening 142. This is possible as once the flow through the fluid outlet 114 is partially blocked, the entrainment effect of drawing a second fluid 146 into the second fluid opening 142 is reduced and at a certain percentage of blocking of the fluid outlet 114 there will be minimal entrainment of a second fluid 146. In addition regardless of the extent of any blockage to the fluid outlet 114 the fan unit 70 in the hairdryer will be processing the same amount of fluid through to the primary fluid outlet 440 and at a certain percentage or extent of blockage, this flow rate and the pressure of the primary flow will exceed the opposing pressure of the second fluid flow 146 causing the primary flow to exit the attachment via the second fluid flow path 120. This is an important safety feature as if the primary flow did not have an alternative exit or outlet; the pressure within the hairdryer would increase and might cause damage to the fan unit 70.

In this embodiment, the first wall 130 is formed from a plastic material capable of withstanding the temperatures experienced in a hairdryer suitable examples include polycarbonate, glass-filled PPA (Polyphthalamide), PPS (Polyphenylene Sulphide), LCAP (Liquid Crystal Aromatic Polymer) or PEEK (Polyether ether ketone) and the skilled person will appreciate that this list is not exhaustive.

The second wall 140 is formed from a silicon rubber which is pulled over the first wall 130 and held in position a plurality of ribs 172 that extend axially along and radially around the elliptical section 136 of the first wall 130 and by a front rim 170 which extends around the fluid outlet 114 and is connected or bridged to the first wall 130 by the ribs 172. These ribs 172 are spacers that maintain a gap between the first wall 130 and the second wall 140 which forms the second fluid flow path 120. An advantage of using a rubber for the second wall 140 is that it provides a cool wall over the second part 108 of the attachment so, the heated primary flow that flows along the first fluid flow path 110 is spaced from the second wall 140 of the attachment. In the event of a blockage where the primary flow escapes 148 along the second fluid flow path 120, the rubber is slow to absorb heat and any blockage would quickly become apparent to a user preventing prolonged exposure to the rubber of directly heated flow.

Referring now to FIGS. 8 to 13, a second embodiment will now be described. For features that are in common with the attachment 100 described with respect to FIGS. 1 to 7, the same reference numerals have been used.

The hairdryer 10 works as described with respect to FIG. 3 in particular and a primary fluid outlet 440 is provided as an annular orifice. This primary fluid outlet 440 is in fluid communication with a fluid inlet 112 into the attachment 200 when the attachment is attached to the hairdryer 10.

In this embodiment, the attachment 200 has a second wall 210 which is formed of plastic as a single unit with the first wall 130. The first wall 130 is recessed within the second wall 210 so does not extend to the second end 104 of the attachment 200. A second fluid flow path 220 is formed between the first wall 130 and the second wall 210. The second wall 210 extends from the second end 104 towards the upstream end 108*a* of the second part 108 of the attachment 200 but does not extend all the way to the upstream end 108*a*, thus a second fluid opening 222 is formed between the upstream end 210*a* of the second wall 210 and the first wall 130.

During normal use, fluid flow from the hairdryer via the primary fluid outlet 440 into the first fluid flow path 110 through the first annular section 110*a* to the second elliptical section 110*b* and the fluid outlet 114. The action of the fluid flowing along the first fluid flow path 110 draws in or entrains a second fluid flow 146 into the second fluid opening 222 and along the second fluid flow path 220. At the downstream end 136*b* of the first wall 130, the first 110 and second 220 fluid flows unite or combine and flow out of the fluid outlet 114.

In the event that there is a blockage to the fluid outlet 114, the second fluid flow path 220 provides an alternative outlet for the fluid flowing in the first fluid flow path 110 in the form of the second fluid opening 222. If the fluid outlet 114 is blocked, then an escape path 248 for the first fluid flow is provided by the gap 244 between the downstream end 136*b* of the first wall 130 and the downstream end 210*b* of the second wall 210 along the second fluid flow path 220 to the second fluid opening. This stops a blockage at the fluid outlet 114 causing a pressure rise and possible damage to the fan unit 70 of the hairdryer 10.

Figure 12:
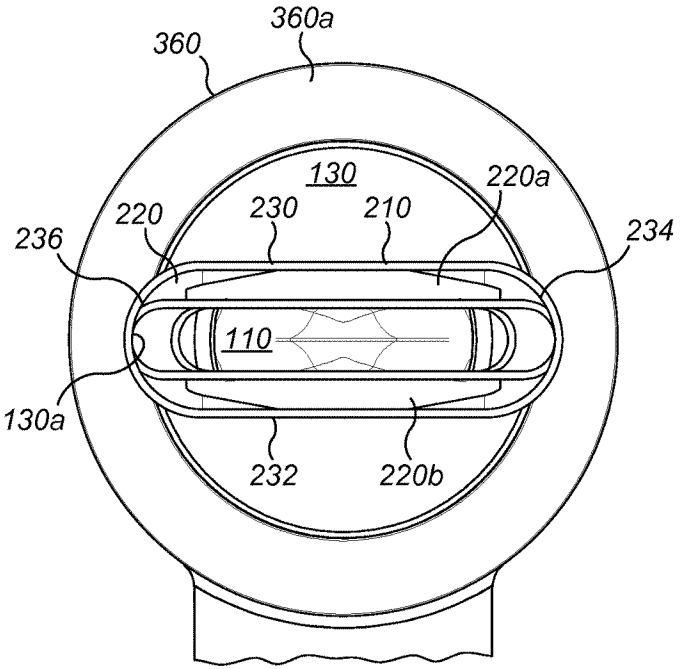
FIG. 12 shows an end view of the attachment of FIG. 8.

Referring now to FIG. 12 in particular, in this embodiment, the second fluid flow path 220 is non-continuous around the first fluid flow path 110. The fluid outlet at the downstream end 210*b* of the second wall 210 is generally elliptical in shape but has flattened sides top 230 and bottom 232 (in the orientation shown). In other words the long axis of the ellipse includes the flattened sides 230,232 whereas the short axis of the ellipse includes rounded sides 234,236. At the rounded sides, the first wall 130 joins with the rounded sides 234,236 of the second wall 210 so the second fluid flow path is split into a first portion 220*a* and a second portion 220*b*. Thus, the inner surface 130*a* of the first wall becomes the inner surface of the second wall 210 where the first 130 and second 210 walls merge. The reason for this is that the first 130 and second 210 walls of the attachment 200 are formed from a single piece of moulded plastic and the second fluid flow path 220 is machined in a post moulding process. The space at the rounded sides 234,236 is restricted so to limit the cost of manufacture the second fluid flow path 220 is machined as two portions 220*a*, 220*b*.

Figure 14:
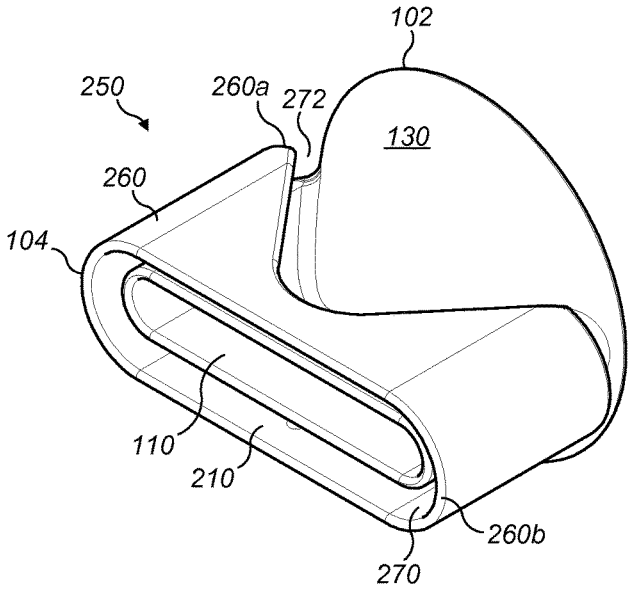
FIG. 14 shows a further alternative attachment.
Figure 15:
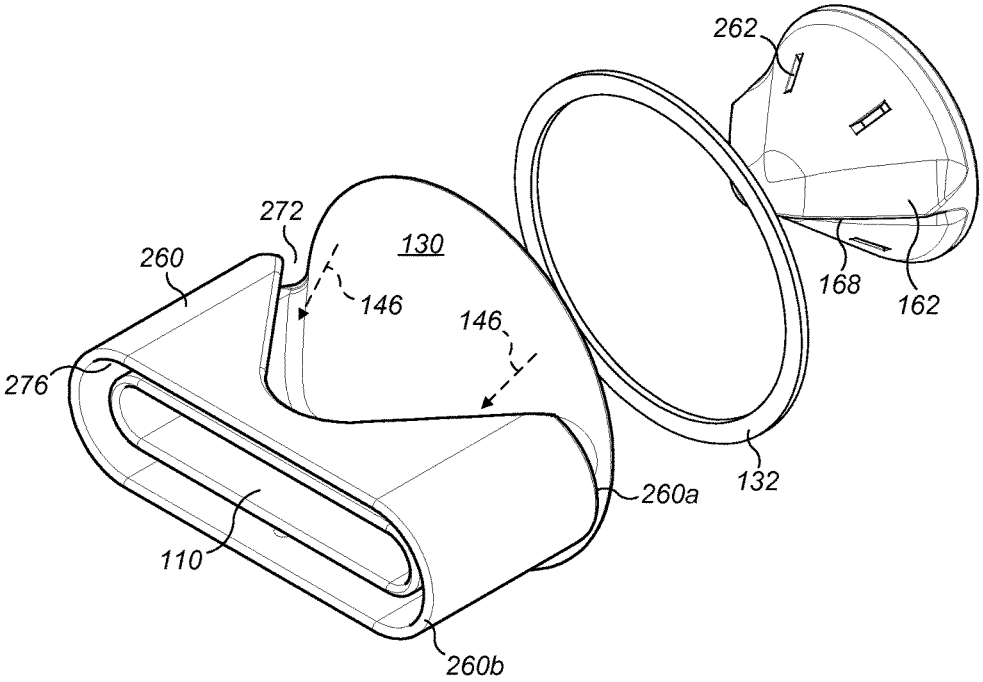
FIG. 15 shows an exploded view of the attachment shown in FIG. 14.
Figure 17:
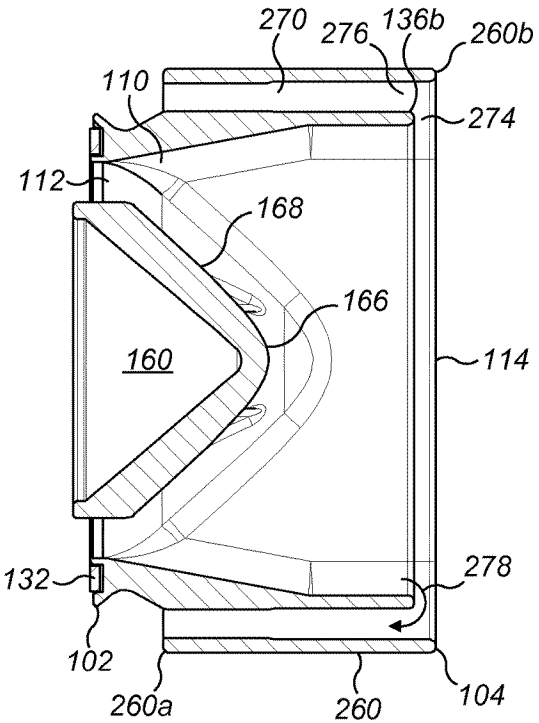
FIG. 17 shows a cross section through the top of the attachment of FIG. 14.
Figure 16:
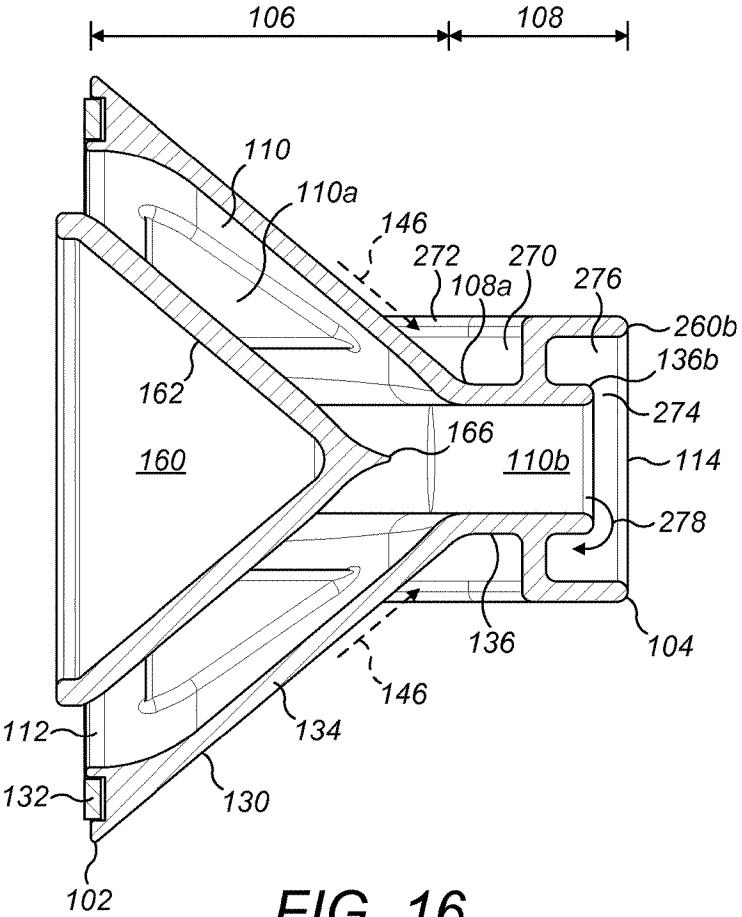
FIG. 16 shows a cross section though the side of the attachment shown in FIG. 14.

In FIG. 14, a further attachment 250 is shown. In this embodiment features that are in common with the attachments 100,200 described with respect to FIGS. 1 to 13, the same reference numerals have been used.

In this embodiment, the first 130 wall and the second wall 260 are moulded in plastic as a single unit and the second fluid flow path 270 extends all the way around or about the first fluid flow path 110. The bung 160 is subsequently ultrasonically moulded onto the inner surface 130*a* of the first wall 130 via four spaced apart ribs 262. The first wall 130 is recessed within the second wall 260 so does not extend to the second end 104 of the attachment 250. A second fluid flow path 270 is formed between the first wall 130 and the second wall 260. The second wall 260 extends from the second end 104 towards the upstream end 108*a* of the second part 108 of the attachment 250. The second wall 270 does not extend all the way to the upstream end 108*a* thus a second fluid opening 272 is formed between the upstream end 260*a* of the second wall 260 and the first wall 130.

During normal use, fluid flow from the hairdryer via the primary fluid outlet 440 into the fluid inlet 112 of the attachment and the first fluid flow path 110 through the first annular section 110*a* to the second elliptical section 110*b* and the fluid outlet 114. The action of the fluid flowing along the first fluid flow path 110 draws in or entrains a second fluid flow 146 into the second fluid opening 272 and along the second fluid flow path 270. At the downstream end 136*b* of the first wall 130, the first 110 and second 270 fluid flows unite or combine and flow out of the fluid outlet 114.

In the event that there is a blockage to the fluid outlet 114, the second fluid flow path 270 provides an alternative outlet for the fluid flowing in the first fluid flow path 110 in the form of the second fluid opening 272. If the fluid outlet 114 is blocked, then an escape path 278 for the first fluid flow is provided by the gap 274 between the downstream end 136*b* of the first wall 130 and the downstream end 260*b* of the second wall 260 along the second fluid flow path 270 to the second fluid opening 272. This stops a blockage at the fluid outlet 114 causing a pressure rise and possible damage to the fan unit 70 of the hairdryer 10.

In this embodiment the second fluid flow path 270 is continuous around the first fluid flow path 110 and along the length of the second wall 260. The fluid outlet 276 formed at the downstream end 136*b* of the first wall 130 is generally elliptical or oval and surrounds the end of the first fluid flow path 110. An advantage of having a continuous second fluid flow path 270 is that a gap is maintained all around the first fluid flow path 110. So the second fluid flow path 270 in addition to providing either external entrainment or an escape route for the first fluid flow in the event of at least a partial blockage of the fluid outlet 114 insulates the heated first fluid flow flowing in the first fluid flow path 110. Thus, the second wall 260 is a cool wall and prevents a user from directly contacting a surface (the first wall 110) which is directly in contact with a heated fluid flow (the first fluid flow).

For the embodiment described in relation to FIGS. 8 to 13, the second fluid flow path 220 is non-continuous around the first fluid flow path 110 so a cool wall is only provided at those regions where the second fluid flow is about the first fluid flow which in this example is along the long axis of the ellipse having flattened sides 203, 232. However, this encompasses the majority of circumference of the first wall 130 so is still effective as a cool wall.

In all the embodiments shown, the attachment 100, 200, 250 has a circular inlet end of first end 102 and an elliptical or oval second end 104 or outlet end. The long axis of the ellipse is longer than or of greater dimension than the diameter of the circular inlet or first end 102. The shorter axis of the ellipse is less than or of smaller dimension than the diameter of the circular inlet or first end 102.

In this embodiment, the bung 160 does not have a base 164; the base is a glamour cap to hide the internal workings of the bung for example if the bung were attached to the rest of attachment using screws this would be hidden from the user when the attachment is not attached to a hairdryer.

The bung may be attached to the rest of the attachment by any of a number of means including and not limited to welding, screwing and gluing as will be apparent to the skilled person. Likewise, the attachment may be attached to the hairdryer by any of a number of methods including but not limited to magnets, snap fit, friction fit and even a permanent method such as welding or gluing as will be apparent to the skilled person and dependent on the materials used for each part.

Whilst the attachments 100, 200, 250 shown have been depicted with an amplifying hairdryer 10, in other words a hairdryer where the processed flow (that flowing though the fan unit) is augmented or amplified by an entrained flow they are equally applicable to use with a conventional hairdryer in which case either the bung 160 is removed from the attachment or, the bung 160 instead of blocking an internal duct 310 would partially block the primary flow diverting a circular flow into an annular flow over its' surface.

Other features of the hairdryer 10 and attachment 100, 200, 250 may be changed without affecting the inventive concept disclosed herein. The shape of the attachment inlet 112, outlet 114 are variable and the attachment need not be provided in two parts 106, 108 with distinctive shapes. The attachment could be a diffuser rather than a concentrator. The hairdryer inlet, control buttons and internal features such as the fan unit, heater and PCB are all exemplary.

The invention claimed is:

1. An attachment for a handheld appliance, the attachment having a first end for connection to the appliance and a second end, a first wall extending from the first end towards the second end and defining a first fluid flow path through the attachment, a second wall extending from the second end towards the first end about the first wall and defining a second fluid flow path extending between the first wall and the second wall, wherein a fluid inlet is defined by the first wall and a wall of a central portion, the first wall extends around and at least partially along the wall of the central portion, and the central portion is configured to at least partially block a fluid outlet of the handheld appliance.

2. The attachment for a handheld appliance of claim 1, wherein the fluid inlet is annular.

3. The attachment of claim 2, wherein the first end of the appliance is substantially circular.

4. The attachment of claim 1, wherein a perimeter of the wall of the central portion is substantially equidistant from a perimeter of the first wall along all sides at the fluid inlet.

5. The attachment of claim 1, wherein the first fluid flow path is defined by the first wall and the wall of the central portion.

6. The attachment of claim 5, wherein a perimeter of the wall of the central portion is substantially equidistant from a perimeter of the first wall along a length of the wall of the central portion.

7. The attachment of claim 5, wherein a perimeter of the wall of the central portion is substantially equidistant from a perimeter of the first wall on all sides along the wall of the central portion.

8. The attachment of claim 1, wherein the second end of the attachment is non-circular.

9. The attachment of claim 8, wherein the second end of the attachment has a dimension that is greater than the first end of the attachment.

10. The attachment of claim 9, wherein the second end of the attachment describes an ellipse.

11. The attachment of claim 1, wherein the second fluid flow path extends substantially continuously around the first fluid flow path.

12. The attachment of claim 1, wherein the second wall comprises a fluid outlet from the attachment.

13. The attachment of claim 1, wherein the first wall comprises a first section and a second section and the first section is a different shape than the second section.

14. The attachment of claim 13, wherein the first section extends from the first end of the attachment.

15. The attachment of claim 13, wherein the first section is frustoconical.

16. The attachment of claim 13, wherein the second section extends from the first section towards the second end and the second section is elliptical.

17. The attachment of claim 13, wherein the second wall extends from the second end at least partially along the second section of the first wall.

18. The attachment of claim 13, wherein the wall of the central portion extends along the first section of the attachment.

19. The attachment of claim 18, wherein a perimeter of the wall of the central portion is equidistant from a perimeter of the first wall along a length of the wall of the central portion.

20. The attachment of claim 18, wherein a perimeter of the wall of the central portion is equidistant from a perimeter of the first wall on all sides along the wall of the central portion.

21. The attachment of claim 1, wherein the second fluid flow path includes a fluid opening at the second end.

22. The attachment of claim 21, wherein the fluid opening is defined by the first wall and the second wall.

23. The attachment for a handheld appliance of claim 1, wherein a first fluid opening is defined by the first wall and the second wall.

24. The attachment of claim 23, wherein the first fluid opening is elliptical.

25. The attachment of claim 23, wherein the second fluid flow path includes a second fluid opening which is at least partially defined by the first wall.

26. The attachment of claim 25, wherein either the first fluid opening or the second fluid opening is a fluid inlet.

27. The attachment of claim 25, wherein either of the first fluid opening or the second fluid opening is a fluid outlet.

28. The attachment of claim 1, wherein in use, fluid flowing in the first fluid flow path flows from the first end towards the second end.

29. The attachment of claim 1, wherein in use, fluid flowing in the second fluid flow path flows either from the first end towards the second end or from the second end towards the first end.

30. The attachment of claim 1, wherein fluid output from the attachment is output from the second end of the attachment.

31. The attachment of claim 30, wherein the fluid output is a combination of fluid from the first fluid flow path and fluid from the second fluid flow path.

32. The attachment of claim 1, wherein the attachment is configured so that fluid from the first fluid flow path flows along the second fluid flow path to a fluid opening formed between the first wall and the second wall.

33. The attachment of claim 1, wherein the first wall is made from a plastic material.

34. The attachment of claim 1, wherein the second wall is made from a plastic material.

35. The attachment of claim 1, wherein the second wall is formed from a flexible material.

36. A hair care appliance comprising: a handle and a body, a primary fluid flow path extending from a primary fluid inlet into the appliance to a primary fluid outlet for emitting the fluid flow from a front end of the body, a fan unit for drawing primary flow into the primary fluid inlet and an attachment, the attachment having a first end for connection to the appliance and a second end, a first wall extending from the first end towards the second end and defining a first fluid flow path through the attachment, a second wall extending from the second end towards the first end about the first wall and defining a second fluid flow path extending between the first wall and the second wall, wherein a fluid inlet into the attachment is defined by the first wall and a wall of a central portion, the first wall extends around and at least partially along the wall of the central portion, and the central portion is configured to at least partially block a further fluid outlet of the hair care appliance.

37. The hair care appliance of claim 36, wherein the first fluid flow path extends from the fluid inlet into the attachment to a fluid outlet from the second end of the attachment and the fluid inlet is in fluid communication with the primary fluid outlet.

38. The appliance of claim 36, wherein the body comprises a duct; a further fluid flow path extending through the duct and from a further fluid inlet through which a further fluid flow enters the appliance to the further fluid outlet for emitting the further fluid flow from a front end of the body and wherein the appliance is configured so that further fluid flow is drawn through the further fluid flow path by fluid emitted from the primary fluid outlet.

39. The appliance of claim 38, wherein the fluid inlet into the attachment is annular.

40. The appliance of claim 38, wherein the central portion extends across the further fluid outlet to reduce the further fluid flow that is drawn into the further fluid flow path.

41. The appliance of claim 40, wherein the wall of the central portion further defines, along with the first wall, the first fluid flow path through the attachment.

42. The appliance of claim 41, wherein the wall of the central portion is cone shaped and a base of the cone extends into the duct.

43. The appliance of claim 42, wherein the central portion further includes a base wall that extends across the base of the cone.

44. The appliance of claim 36, wherein the primary fluid inlet is in the handle.

45. The appliance of claim 36, wherein the fan unit is in the handle.

* * * * *